US009039243B2

(12) United States Patent
Ju et al.

(10) Patent No.: US 9,039,243 B2
(45) Date of Patent: May 26, 2015

(54) LIGHTING APPARATUS

(71) Applicant: LG ELECTRONICS INC., Seoul (KR)

(72) Inventors: Hokyun Ju, Seoul (KR); Inhwan Ra, Seoul (KR); Kiwoong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/292,704

(22) Filed: May 30, 2014

(65) Prior Publication Data

US 2014/0268833 A1 Sep. 18, 2014

Related U.S. Application Data

(63) Continuation of application No. 14/074,953, filed on Nov. 8, 2013.

(30) Foreign Application Priority Data

Nov. 12, 2012 (KR) ..... 10-2012-0127254

(51) Int. Cl.

| | |
|---|---|
| ***F21V 29/00*** | (2006.01) |
| ***F21K 99/00*** | (2010.01) |
| ***F21V 3/02*** | (2006.01) |
| ***F21V 17/00*** | (2006.01) |
| ***F21V 23/00*** | (2006.01) |

(Continued)

(52) U.S. Cl.

CPC ..... *F21V 29/2206* (2013.01); *F21V 29/2231* (2013.01); *F21K 9/1355* (2013.01); *F21K 9/1375* (2013.01); *F21V 3/02* (2013.01); *F21V 17/002* (2013.01); *F21V 23/009* (2013.01); *F21K 9/52* (2013.01); *F21V 29/22* (2013.01); *F21V 7/00* (2013.01); *F21V 23/045* (2013.01)

(58) Field of Classification Search

CPC ..... F21V 29/22; F21V 17/002; F21K 9/52; F21K 9/1355; F21K 9/1375

See application file for complete search history.

(56) References Cited

U.S. PATENT DOCUMENTS

| | | | | |
|---|---|---|---|---|
| 2002/0048169 | A1 | 4/2002 | Dowling et al. | 362/234 |
| 2010/0118148 | A1 | 5/2010 | Lee | 348/164 |

(Continued)

FOREIGN PATENT DOCUMENTS

| | | | |
|---|---|---|---|
| AU | 2012101135 | A4 | 8/2012 |
| KR | 10-2010-0018893 | A | 2/2010 |
| WO | WO 2009/103587 | A1 | 8/2009 |

OTHER PUBLICATIONS

European Search Report dated Feb. 13, 2014, issued in Application No. 13 19 2110.

*Primary Examiner* — Bao Q Truong

(74) *Attorney, Agent, or Firm* — Ked & Associates, LLP

(57) ABSTRACT

Disclosed is a lighting apparatus which may include a heat sink, a light emitting device including a substrate mounted on the heat sink and LEDs arranged on the substrate, a bulb surrounding the light emitting device, an electronic module received within the heat sink to supply power to the light emitting device, a case provided to surround the electronic module, the case being configured to be inserted into the heat sink, a communication module separably coupled to the electronic module, and a power socket electrically connected to the electronic module, the power socket being mounted to the case. The communication module may include a housing, a circuit board provided in the housing. The circuit board may be electrically connected to the electronic module, and a wireless communication device may be provided on the circuit board.

20 Claims, 10 Drawing Sheets

(51) Int. Cl.
*F21V 7/00* (2006.01)
*F21V 23/04* (2006.01)

(56) References Cited

U.S. PATENT DOCUMENTS

2011/0134634 A1 6/2011 Gingrich, III et al. ..... 362/231
2012/0026740 A1* 2/2012 Kim et al. ..... 362/294
2012/0274208 A1 11/2012 Chen et al. ..... 315/34
2013/0128573 A1* 5/2013 Leung et al. ..... 362/235
2013/0294071 A1* 11/2013 Boomgaarden et al. ..... 362/235
2013/0301268 A1* 11/2013 Johnston et al. ..... 362/249.02
2014/0092602 A1* 4/2014 Chen ..... 362/294
2014/0126220 A1* 5/2014 Chen et al. ..... 362/311.02
2014/0210333 A1* 7/2014 Kang ..... 313/46

* cited by examiner

LIGHTING APPARATUS

CROSS-REFERENCE TO RELATED APPLICATION(S)

This application is a continuation of application Ser. No. 14/074,953, filed on Nov. 8, 2013, which claims the benefit of Korean Patent Application No. 10-2012-0127254, filed on Nov. 12, 2012, which is hereby incorporated by reference as if fully set forth herein.

BACKGROUND

1. Field

Provided is a lighting apparatus, and more particularly to a lighting apparatus, which may include a lighting control system that facilitates individual/group control in a wireless manner, and which may enhance heat radiation performance, stability and light distribution efficiency.

2. Background

Lighting apparatuses and lighting control systems are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
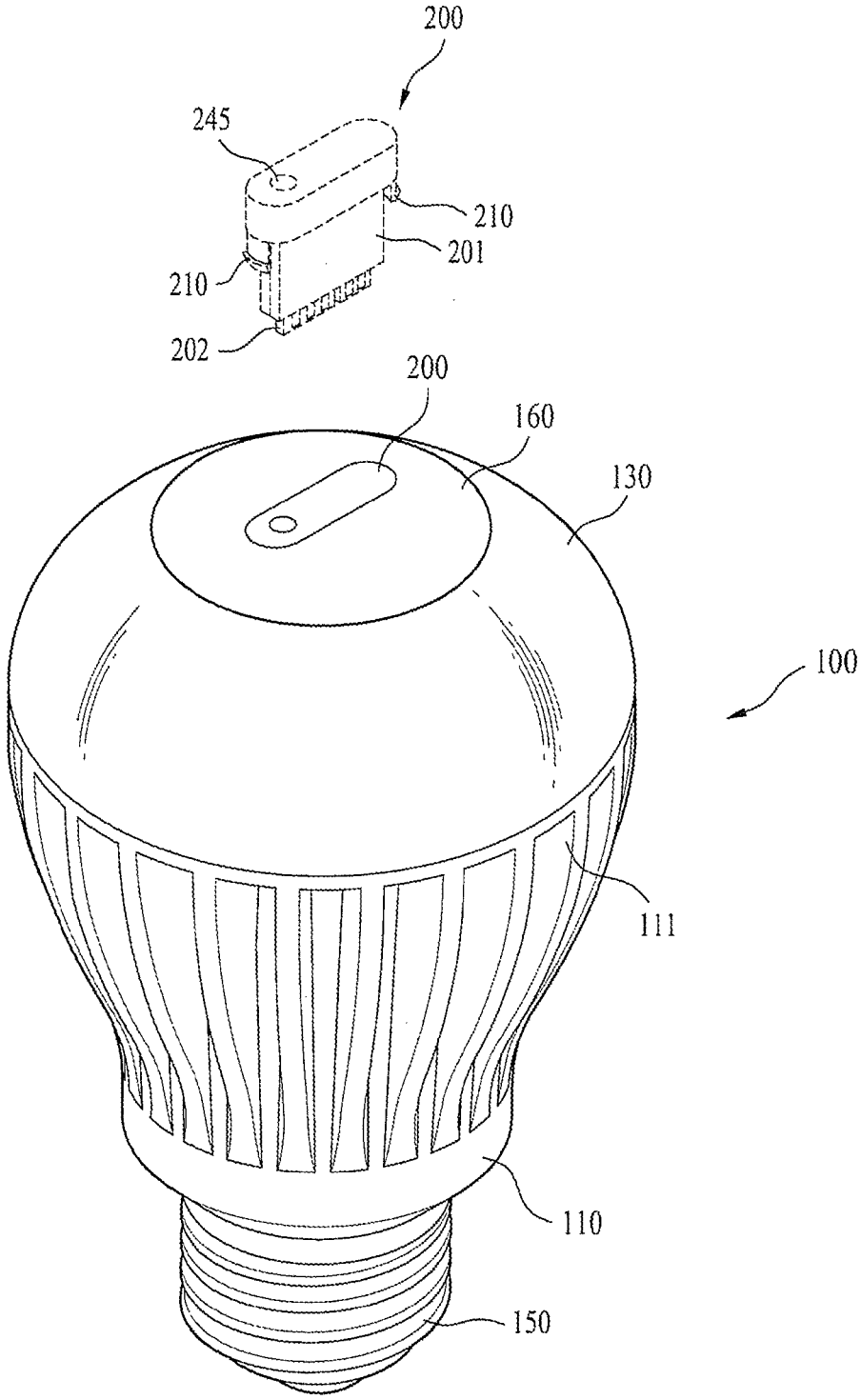
FIG. 1 is a perspective view showing a lighting apparatus according to an embodiment of the present disclosure.

Hereinafter, a lighting apparatus according to the embodiment of the present disclosure will be described in detail with reference to the accompanying drawings. The accompanying drawings show an exemplary configuration of the present disclosure and are provided for more detailed explanation of the present disclosure, and the technical sprit of the present disclosure is not limited thereto.

In addition, the same or similar elements are denoted by the same reference numerals even though they are depicted in different drawings, and a repeated description thereof will be omitted. In the drawings, for convenience of explanation, sizes and shapes of respective constituent members may be enlarged or reduced and may not be to scale.

It will be understood that, although the terms first, second, etc. may be used herein to describe various components, these components should not be limited by these terms. These terms are used simply to discriminate any one component from other components.

Generally, light sources used primarily for lighting equipment are incandescent lamps, discharge lamps, fluorescent lamps, and the like for various purposes, such as home, landscape, industrial use, and the like. Among the aforementioned ones, a resistive light source, such as, for example, an incandescent lamp, has low efficiency and serious heat radiation problems, a discharge lamp has high price and high voltage problems, and a fluorescent lamp entails an environmental problem due to use of mercury.

To solve the problems of the aforementioned light sources, interest in Light Emitting Diode (LED) lighting equipment that has many advantages, including high efficiency, color diversity, design freedom, and the like, is increasing. LEDs are semiconductor devices that emit light when a forward voltage is applied thereto, and have an extended lifespan, low power consumption as well as electrical, optical, and physical characteristics suitable for mass production. Incandescent lamps and fluorescent lamps are quickly being replaced by LEDs.

Large buildings may be equipped with a plurality of LED lighting apparatuses and a lighting control system to implement individual/group control of the LED lighting apparatuses. The lighting control system manages on/off states of LED lighting apparatuses installed in respective floors or particular zones, state information or power usage of each LED lighting apparatus, and the like, in real time to detect unnecessary energy use, thus minimizing energy waste.

In addition, the lighting control system may include a controller that may control a plurality of LED lighting apparatuses in order to take charge in maintenance of building facilities, repair/maintenance of operational facilities, maintenance of a lighting environment inside a building, and management of energy to be consumed during such maintenance work.

Moreover, a plurality of LED lighting apparatuses may be individually connected to the controller in a wired communication manner, thus necessitating a complex wiring process. When it is necessary to establish a novel lighting control system due to rearrangement of the LED lighting apparatuses, use of existing wiring may be difficult, and thus additional wiring may be necessary causing increased costs and complexity in installation.

For these reasons, there is a demand for a novel configuration of communication module that may simply embody a lighting control system and ensure easy individual/group control of LED lighting apparatuses. Accordingly, the present disclosure is directed to a lighting apparatus that substantially obviates one or more problems due to limitations and disadvantages of the related art.

An object of the present disclosure is to provide a lighting apparatus that may embody a lighting control system to achieve easy individual/group control in a wireless manner without an additional wiring process. Another object of the present disclosure is to provide a lighting apparatus to which a separate wireless communication module may be separably coupled. Another object of the present disclosure is to provide a lighting apparatus that enables control of on/off, dimming, or color temperature thereof in a wireless manner. Another object of the present disclosure is to provide a lighting apparatus that may enhance heat radiation performance. A further object of the present disclosure is to provide a lighting apparatus that enables simplified assembly and installation as well as easy repair and replacement.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

The lighting apparatus according to the present disclosure may be a bulb type lighting apparatus, or a Parabolic Aluminized Reflector (PAR) type lighting apparatus. The lighting apparatus according to an embodiment of the present disclosure may include a heat sink, and a light emitting unit which includes a substrate mounted on the heat sink and LEDs arranged on the substrate.

In addition, the lighting apparatus may include a bulb surrounding the light emitting unit, an electronic module which is received within the heat sink to supply power to the light emitting unit, and a case (or housing or enclosure) which is configured to surround the electronic module and inserted into the heat sink. In addition, the lighting apparatus may include a communication module separably coupled to the electric unit, and a power socket electrically connected to the electric unit, the power socket being mounted to the case. Here, the communication module may include a housing, a circuit board which is placed in the housing and electrically connected to the electric unit, and a wireless communication unit provided on the circuit board.

Figure 2:
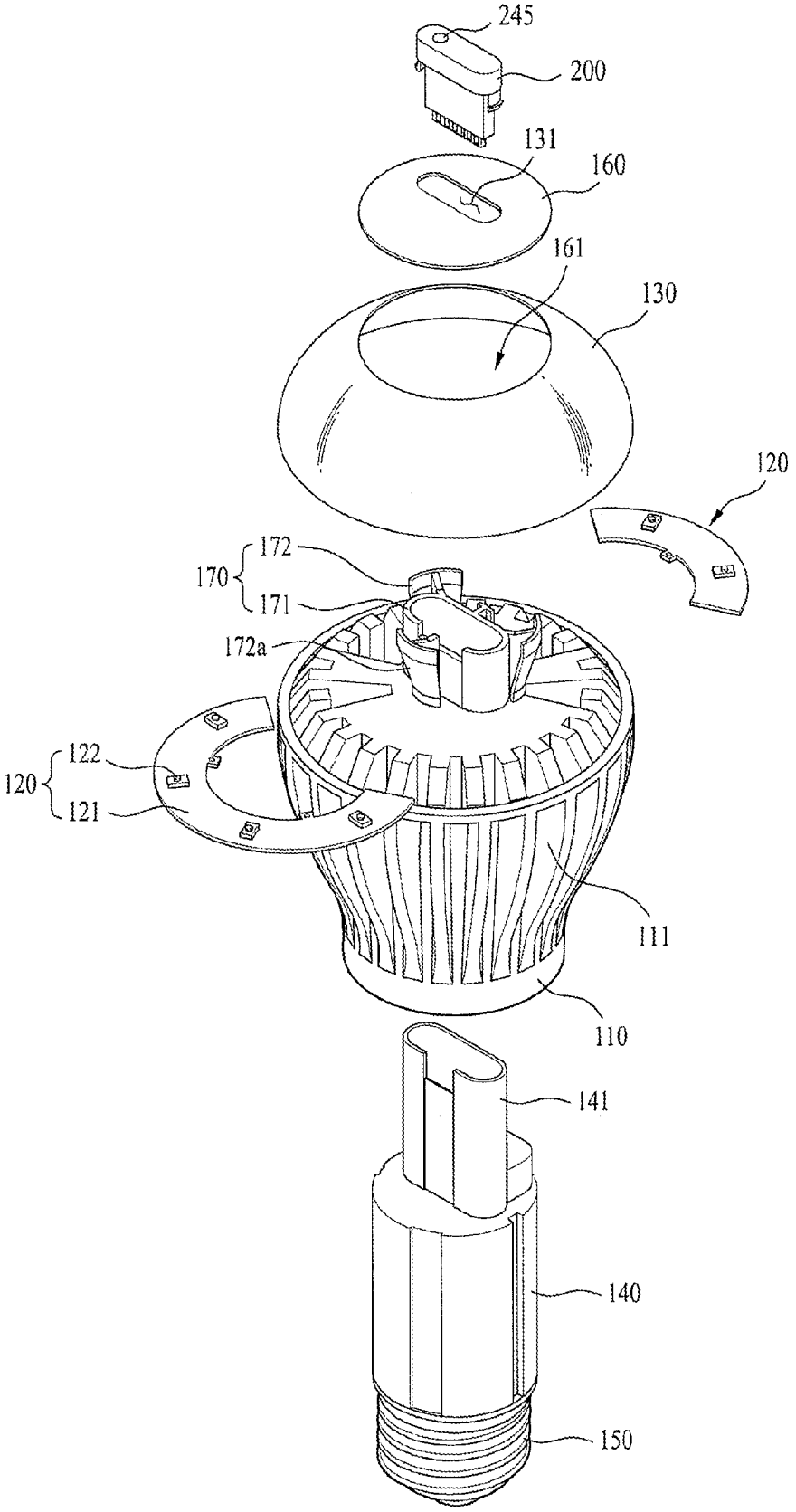
FIG. 2 is an exploded perspective view showing the lighting apparatus according to an embodiment of the present disclosure.
Figure 3:
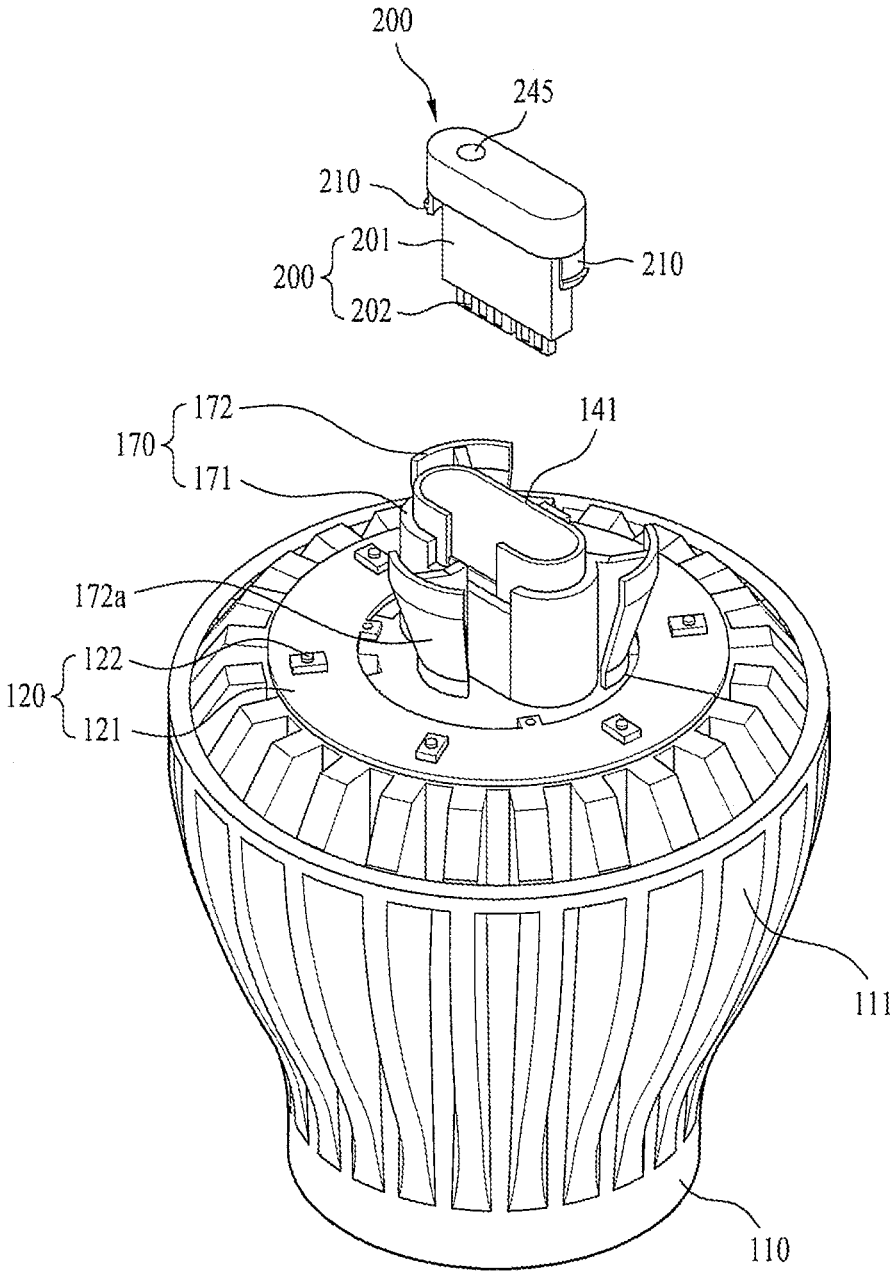
FIG. 3 is a perspective view showing main components of the lighting apparatus according to an embodiment of the present disclosure.
Figure 4:
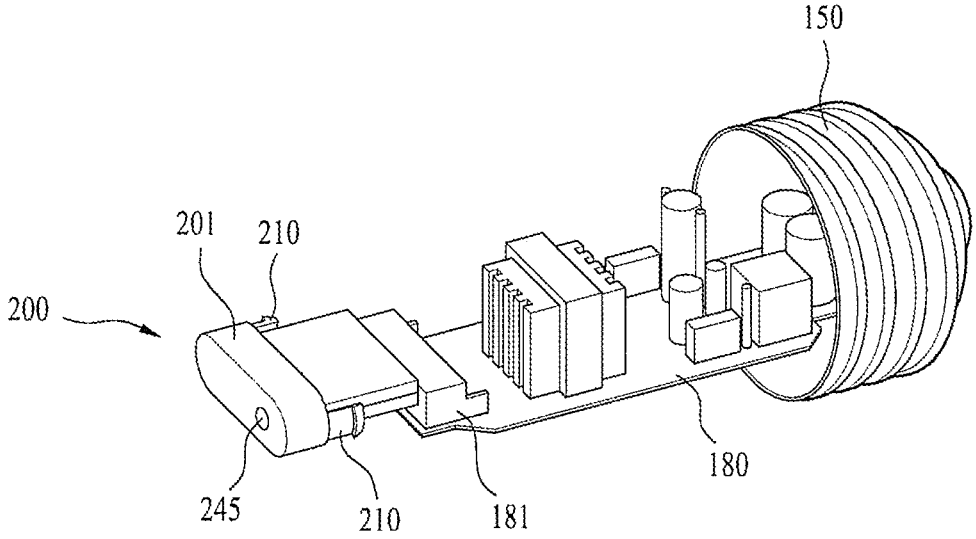
FIG. 4 is a perspective view for explanation of a mounted state of a communication module included in the lighting apparatus according to an embodiment of the present disclosure.

FIG. 1 is a perspective view showing a lighting apparatus according to an embodiment of the present disclosure, FIG. 2 is an exploded perspective view showing the lighting apparatus, FIG. 3 is a perspective view showing main components of the lighting apparatus, and FIG. 4 is a perspective view that illustrates a mounted state of a communication module included in the lighting apparatus according to an embodiment of the present disclosure.

The lighting apparatus, designated by reference numeral 100, may be equipped with a communication module 200 which receives a control signal for the lighting apparatus 100 and transmits a signal indicating an operating state of the lighting apparatus 100. The communication module 200 may be separably coupled to the lighting apparatus 100 for easy repair and replacement. In addition, the communication module 200 may include a wireless communication unit for wireless communication with a terminal (see, for example, terminal 300 of FIG. 8) that controls the lighting apparatus 100.

More specifically, the communication module 200 may receive a control signal for the lighting apparatus 100 that is transmitted from the terminal 300. In addition, the communication module 200 may transmit a signal indicating an operating state of the lighting apparatus 100 to the terminal 300. A user may control, for example, on/off states, dimming, and/or color temperature of the lighting apparatus 100 via the terminal 300. In addition, the user may monitor an operating state of the lighting apparatus 100 via the terminal 300.

An electronic module 180 may serve to supply power to a light emitting unit 120. The electronic module 180 may control an operating state of the light emitting unit 120. The communication module 200 may be electrically connected to the electronic module 180.

Hereinafter, respective components of the lighting apparatus 100 will be described in detail with reference to the accompanying drawings.

A heat sink 110 may be provided to outwardly radiate heat generated by the light emitting unit 120. The heat sink 110 may be formed of a highly thermally conductive metal or resin material. The heat sink 110 may be provided with a plurality of heat radiating fins 111 to increase a heat exchange area with outside air. The heat sink 110 may approximately take the form of a longitudinally extending cylinder, and may internally define an empty space (or cavity) for insertion of a case 140. In addition, the heat sink 110 may have a first surface on which the light emitting unit 120 is disposed, and a second surface opposite to the first surface, at which the case 140 is inserted. The first surface may be a top surface of the light emitting unit 120 and the second surface may be an inner surface in the cavity.

The light emitting unit 120 may include a substrate 121 mounted on the heat sink 110, and LEDs 122 arranged on the substrate 121. One or a plurality of light emitting units 120 may be disposed on the heat sink 110, and light emitting units 120 may have various configurations, such as a chip, package, and the like. Moreover, the bulb 130 may be mounted to the heat sink 110 to surround the light emitting unit 120.

The case 140 may function to insulate the electronic module 180 from the heat sink 110. To this end, the case 140 may be formed of a resin material. The case 140 may be configured to surround the electronic module 180 and may be inserted into the heat sink 110. In addition, the electronic module 180 may be electrically connected to the light emitting unit 120 via a cable or flexible circuit board, for example.

As described above, the electronic module 180 may include a power supply to supply power to the light emitting unit 120, and a variety of circuits to control an operating state of the light emitting unit 120. In this case, the communication module 200 may be electrically connected to the electronic module 180. In addition, the case 140 may be equipped with a power socket 150 that is electrically connected to the electronic module 180.

Referring to FIG. 4, the electronic module 180 may include a connector 181. A circuit board 202 of the communication module 200 may be inserted into the connector 181. In this case, external power may be supplied to the lighting apparatus 100 via the power socket 150, and drive power may be supplied to the communication module 200 via the connector 181.

The communication module 200 may be separably coupled to the lighting apparatus 100 in various ways to be removable. In an embodiment, referring to FIGS. 1 and 2, the communication module 200 may be connected to the electronic module 180 through the bulb 130. To this end, the bulb 130 may have an aperture 131, and the communication module 200 may be connected to the electronic module 180 through the aperture 131 of the bulb 130. In this case, the connector 181 of the electronic module 180 may be positioned to face the aperture 131 of the bulb 130.

Referring to FIGS. 2 and 3, the lighting apparatus 100 may further include a mounting member 171 that extends from the heat sink 110 to the aperture 131 of the bulb 130. The mounting member may provide support for a connector as well as being an auxiliary heat sink. A housing 201 of the communication module 200 may pass through the aperture 131 to thereby be inserted into the mounting member 171. The mounting member 171 may take the form of a hollow tubular member for insertion of the communication module 200. A plurality of light emitting units 120 may be radially arranged about the mounting member 171.

The electronic module 180, which may be encased by the case 140, may be inserted into the heat sink 110. Once the housing 201 has been inserted into the mounting member 171, the circuit board 202 of the communication module 200 may be inserted into the connector 181 of the electronic module 180.

The mounting member 171 may be formed of a highly thermally conductive metal material. The mounting member 171 may be provided with a plurality of heat radiating fins 172. The mounting member 171 and the heat radiating fins 172 may function as an auxiliary heat sink 170.

The heat radiating fins 172 may each have a ramped reflective surface 172*a* that is inclined away from the mounting member 171 with decreasing distance to the aperture 131 of the bulb 130. The reflective surface 172*a* may function to reflect light emitted by the light emitting unit 120, for example, toward the heat sink 110.

The case 140 may include a connector 141 that extends to the mounting member 171. In this case, the housing 201 of the communication module 200 may pass through the aperture 131 of the bulb 130 to thereby be inserted into the connector 141. The connector 141 may be formed of a resin material, similar to the case 140. In addition, the connector 141 may function to insulate the mounting member 171 and the communication module 200. That is, the connector 141 may prevent transfer of heat to the communication module 200 through the mounting member 171 and may also be referred to herein as a shield member 141.

In this case, the housing 201 of the communication module 200 may be separably coupled to the shield member 141. In an embodiment, the housing 201 may be provided with one or more hooks 210, and the shield member 141 may be provided with retainers (not shown) by which the hooks 210 are separably caught.

The lighting apparatus 100 may include a reflective member 160 fitted into an opening 161 of the bulb 130. The reflective member 160 may have the aperture 131 formed thereon. The reflective member 160 may function to reflect light emitted by the light emitting unit 120, for example, toward the heat sink 110. The reflective member 160 and the above-described reflective surface 172*a* may function to increase a light distribution area of the lighting apparatus 100, and may contribute to omnidirectional light distribution of the lighting apparatus 100.

Omnidirectional light distribution refers to technology that achieves a minimum increase in luminous flux of 5% at a light distribution angle of 135 degrees or more and has an average luminous flux deviation of less than 20% at a light distribution angle of 0 to 135 degrees. The lighting apparatus 100 according to an embodiment of the present disclosure may be configured to realize omnidirectional light distribution via the reflective member 160 and/or the reflective surface 172*a*.

In this case, the communication module 200 may pass through the aperture 131 of the reflective member 160 to thereby be mounted to the electronic module 180. More specifically, the communication module 200 may pass through the aperture 131 of the reflective member 160 and opening 161 to thereby be inserted into the shield member 141.

Figure 5:
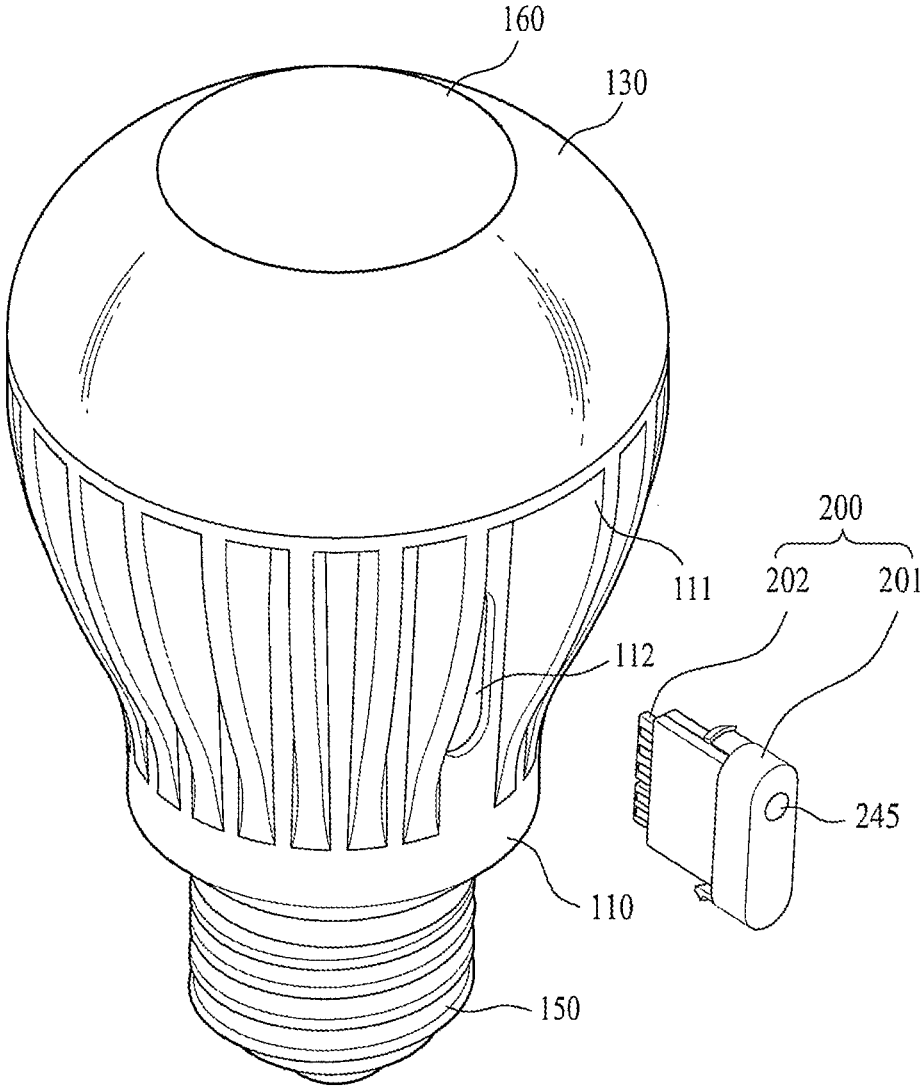
FIG. 5 is a perspective view showing a lighting apparatus according to another embodiment of the present disclosure.

FIG. 5 is a perspective view showing a lighting apparatus according to another embodiment of the present disclosure. Although a configuration for a connection between the communication module 200 and the electronic module 180 through the bulb 130 has been described heretofore, the present disclosure is not limited thereto, and the communication module 200 may be connected to the electronic module 180 through the heat sink 110.

Referring to FIGS. 4 and 5, the heat sink 110 may have an aperture 112, and the communication module 200 may be mounted to the electronic module 180 through the aperture 112. The aperture 112 may be perforated in a specific region of the heat sink 110, and the connector 181 may be positioned to face the aperture 112 of the heat sink 110. In addition, both the heat sink 110 and the case 140 may be provided respectively with apertures that correspond in position to each other, and the communication module 200 may pass through these apertures to thereby be mounted to the electronic module 180.

A configuration in which the case 140 surrounding the electronic module 180 is inserted into the heat sink 110 has been described. Alternatively, the electronic module 180 may be inserted into the heat sink 110 without the case 140. To this end, the lighting apparatus according to another embodiment of the present disclosure may include the heat sink 110 having the aperture 112, and the electronic module 180 which is received within the heat sink 110 to supply power to the light emitting unit 120.

The lighting apparatus may include the bulb 130 surrounding the light emitting unit 120, and the communication module 200 separably coupled to the electronic module 180 through the aperture 112. In addition, the lighting apparatus may include the power socket 150 which is electrically connected to the electronic module 180 and mounted to the heat sink 110. That is, if the lighting apparatus includes the case 140, the power socket 150 may be mounted to the case 140 as described above.

Alternatively, if the lighting apparatus does not include the case 140 and only the electronic module 180 is inserted into the heat sink 110, the power socket 150 may be mounted to the heat sink 110. To this end, the heat sink 110 may be provided with a mounting portion to which the power socket 150 is mounted. The mounting portion may have helical threads.

The heat sink 110 may be formed of a highly thermally conductive resin material. If the electronic module 180 is directly inserted into the heat sink 110 without the case 140, insulation between the electronic module 180 and the heat sink 110 is important. To this end, the heat sink 110 may be formed of a resin material.

The heat sink 110 may contain a guide rail, and the electronic module 180 may be inserted into the heat sink 110 along the guide rail. In this case, the electronic module 180 may be supported by the guide rail. The guide rail may be formed at an inner surface of the heat sink 110 defining an inner space (i.e., the aforementioned empty space), and as necessary a plurality of guide rails may be provided.

In an embodiment, the guide rail may extend, by a predetermined length, in a longitudinal direction of the heat sink 110. A partial region of the circuit board of the electronic module 180 may be located inside the guide rail.

When it is attempted to separate the power socket 150 from the heat sink 110, the electronic module 180 may be separated from the heat sink 110. In this case, the electronic module 180 may slide outward from the heat sink 110 along the guide rail.

As described above, the communication module 200 may include the housing 201, the circuit board 202 which is placed in the housing 201 and electrically connected to the electronic module 180, and the wireless communication unit provided on the circuit board 202. The electronic module 180 may include the connector 181. In this case, the circuit board 202 of the communication module 200 may be inserted into the connector 181 through the aperture 112 of the heat sink 110.

The connector 181 may be positioned to face the aperture 112 of the heat sink 110. More specifically, the connector 181 may be positioned to be outwardly exposed through the aperture 112 of the heat sink 110. As such, in the case in which the electronic module 180 is directly inserted into the heat sink 110, it is possible to reduce the number of components and to ensure simplified repair and replacement of the electronic module 180.

The embodiment in which the communication module 200 is connected to the electronic module 180 through the bulb 130 (see FIG. 1) and the embodiment in which the communication module 200 is connected to the electronic module 180 through the heat sink 110 (see FIG. 5) have been described heretofore. However, the present disclosure is not limited thereto. In an embodiment, the communication module 200 may be selectively connected to the electronic module 180 through the bulb 130 or the heat sink 110.

Referring to FIGS. 2 and 5, the lighting apparatus 100 may include the heat sink 110 having a first aperture 112, and the light emitting unit 120 which includes the substrate 121 mounted on the heat sink 110 and the LEDs 122 arranged on the substrate 121.

The lighting apparatus 100 may include the bulb 130 surrounding the light emitting unit 120, the bulb 130 having a second aperture 131, the electronic module 180 received within the heat sink 110 to supply power to the light emitting unit 120, and the case 140 which is configured to surround the electronic module 180 and inserted into the heat sink 110.

The lighting apparatus 100 may include the communication module 200 separably coupled to the electronic module 180 through the first aperture 112 or the second aperture 131, and the power socket 150 which is electrically connected to the electronic module 180 and mounted to the case 140. Here, the electronic module 180 may include a first connector positioned to face the first aperture 112 and a second connector (see FIG. 4) positioned to face the second aperture 131. In this case, the circuit board 202 of the communication module 200 may pass through the first aperture 112 or the second aperture 131 to thereby be inserted into the first connector or the second connector.

Figure 6:
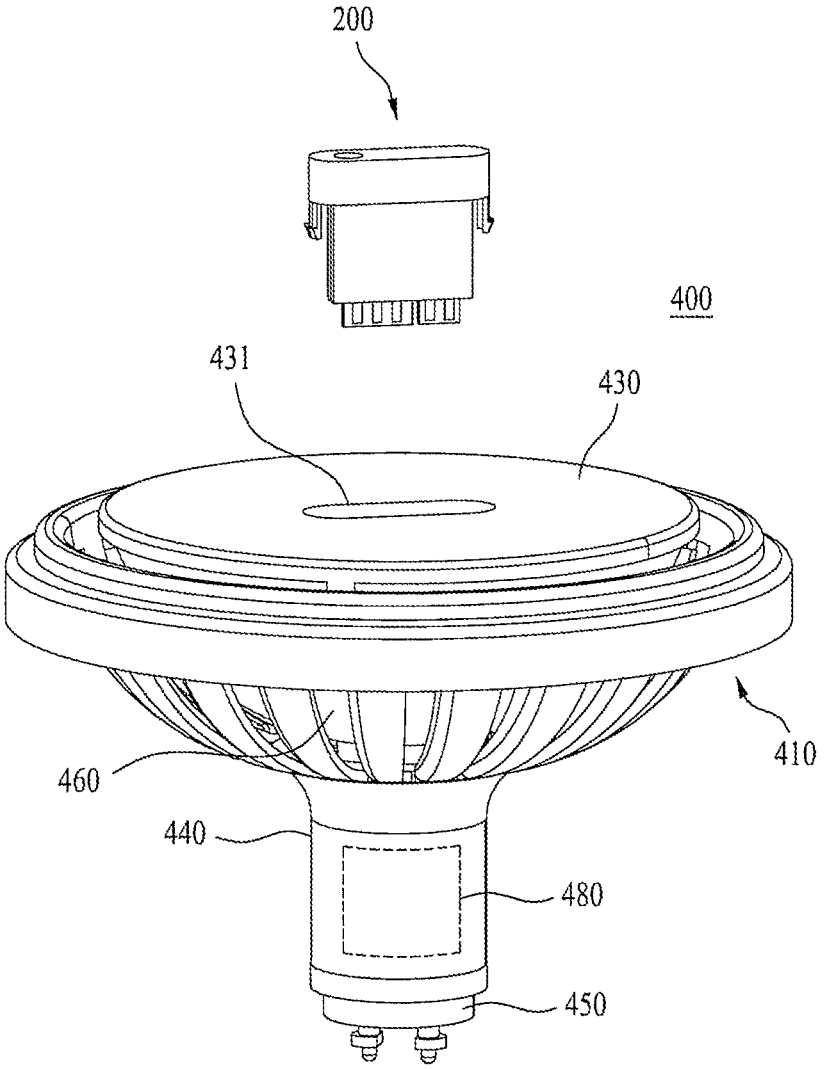
FIG. 6 is a perspective view showing a lighting apparatus according to a further embodiment of the present disclosure.

The bulb type lighting apparatus 100 has been described heretofore, but the present disclosure is not limited thereto and may be applied to a PAR type lighting apparatus. FIG. 6 is a perspective view showing a lighting apparatus according to a further embodiment of the present disclosure. The PAR type lighting apparatus may have a conventionally used known configuration, and FIG. 6 shows only some components.

The PAR type lighting apparatus, designated by reference numeral 400, according to a further embodiment of the present disclosure may include a heat sink 410, and a light emitting unit which may include a substrate placed in the heat sink 410 and LEDs arranged on the substrate.

The lighting apparatus 400 may include a semispherical reflective member 460 mounted to the heat sink 110, and a case 440 mounted to the heat sink 410. The lighting apparatus 400 may include an electronic module 480 which is placed in the case 440 to supply power to the light emitting unit, and a power socket 450 mounted to the case 440. A cover 430 may be mounted on the reflective member 460. The cover 430 may include a micro-lens array or a transparent plate.

In this case, the communication module 200 may pass through the cover 430 to thereby be connected to the electronic module 480. The housing of the communication module 200 may be separably coupled to the cover 430. To this end, the cover 430 may have a through-hole 431. In addition, it is noted that the mounting member (for example, mounting member 171 of FIG. 2) and the shield member (for example, shield member 141 of FIG. 2) for insertion of the communication module 200 may be applied to the PAR type lighting apparatus 400.

Hereinafter, the communication module 200 will be described in detail with reference to the accompanying drawings.

Figure 7:
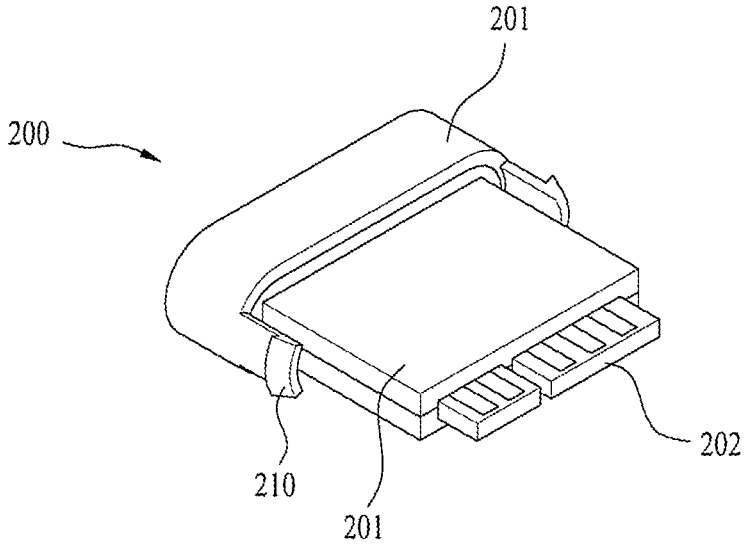
FIG. 7 is a perspective view showing the communication module included in the lighting apparatus according to an embodiment of the present disclosure.
Figure 8:
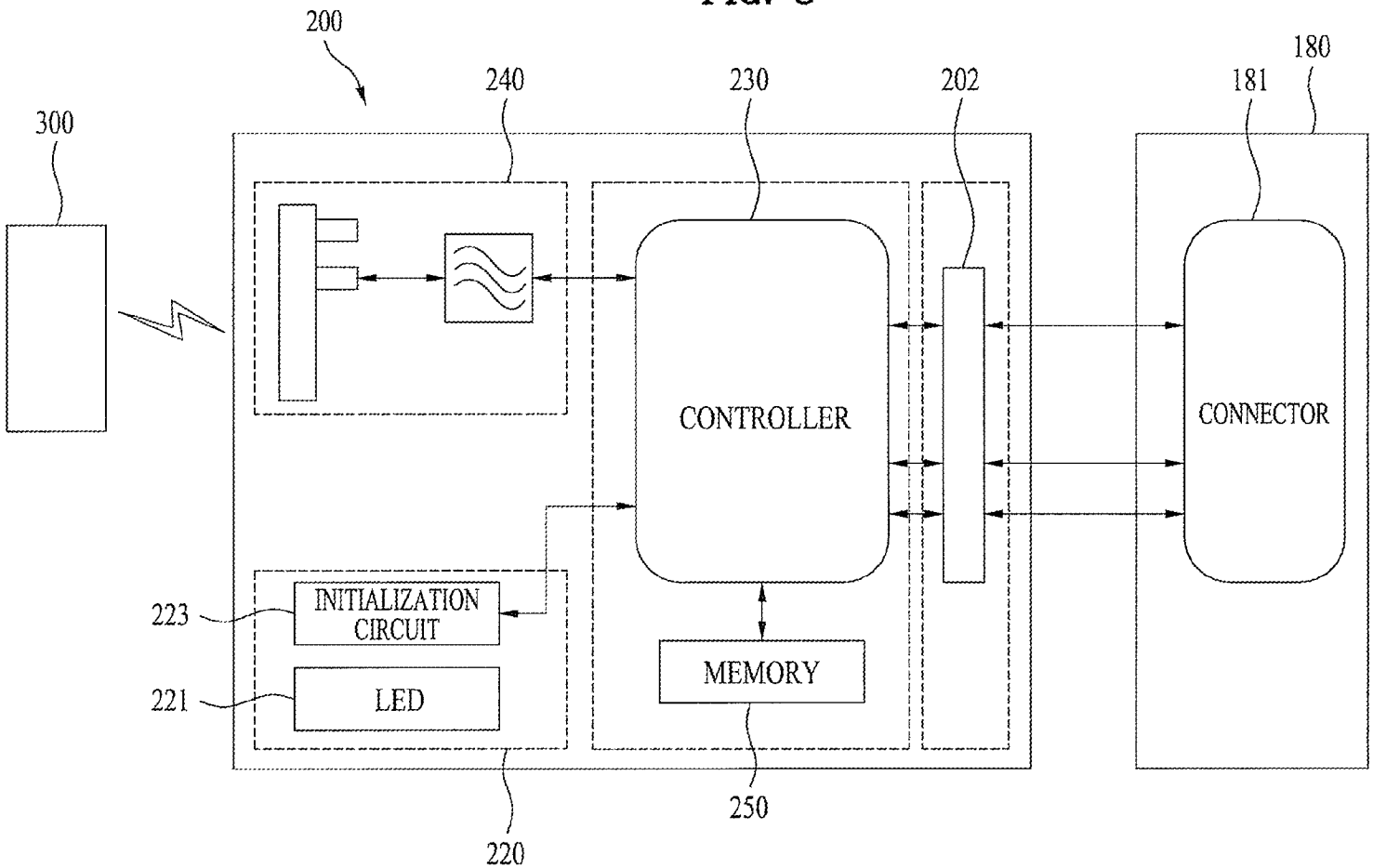
FIG. 8 is a block diagram showing a configuration of the communication module included in the lighting apparatus according to an embodiment of the present disclosure.
Figure 9:
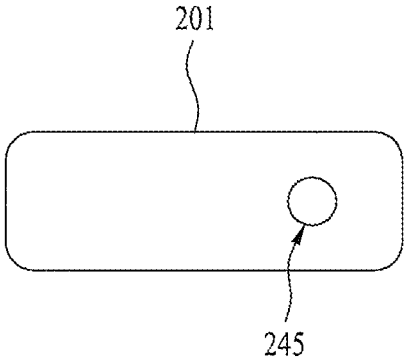
FIG. 9 is a front view showing the communication module included in the lighting apparatus according to an embodiment of the present disclosure.
Figure 10:
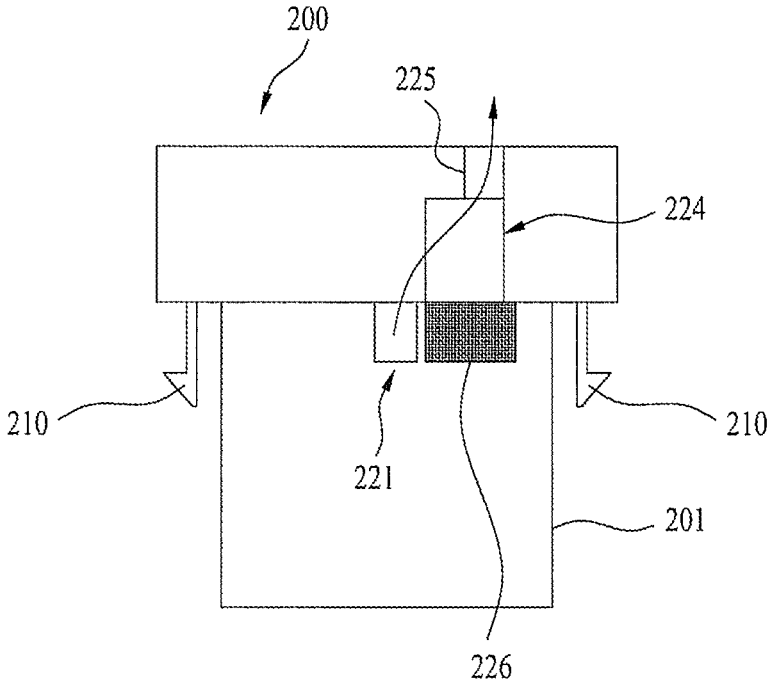
FIG. 10 is a conceptual view showing the communication module included in the lighting apparatus according to an embodiment of the present disclosure.

FIG. 7 is a perspective view showing the communication module included in the lighting apparatus according to an embodiment of the present disclosure, FIG. 8 is a block diagram showing a configuration of the communication module included in the lighting apparatus according to an embodiment of the present disclosure, FIG. 9 is a front view showing the communication module included in the lighting apparatus according to an embodiment of the present disclosure, and FIG. 10 is a conceptual view showing the communication module included in the lighting apparatus according to an embodiment of the present disclosure.

As described above, the communication module 200 may include the housing 201 configured to be separably inserted into the lighting apparatus 100, and the circuit board 202 placed in the housing 201. The communication module 200 may include a wireless communication unit 240 which is provided on the circuit board 202 to receive a control signal for the lighting apparatus 100 and to transmit a signal indicating an operating state of the lighting apparatus 400. In addition, the communication module 200 may include an operating state display unit 220 (or display interface) which may be provided at the housing 201 to display an operating state and receive an initialization instruction, and a controller 230 to control the wireless communication unit 240 and the operating state display unit 220.

A plurality of circuits to implement various functions may be mounted on the circuit board 202. For example, an initialization circuit 223 and a memory 250 may be provided. A partial region of the circuit board 202 may protrude outward from the housing 201 in order to be inserted into the connector 181 of the electronic module 180. In addition, the circuit board 202 may be provided at a partial region thereof with a plurality of pins including pins to receive power from the connector 181, ground pins, and data transmission/reception pins.

Referring to FIGS. 8 and 10, the operating state display unit 210 may include a light source (221, for example, LEDs) arranged on the circuit board 202, and a button 225 exposed outwardly from the housing 201. Moreover, the operating state display unit 210 may further include a light guide member 224 to guide light, emitted by the light source 221, to the button 225, and a switch 226 to sense movement of the light guide member 224.

Referring to FIGS. 9 and 10, the light guide member 224 and the button 225 may be formed of a transparent material. In this case, if the light source 221 is operated, light emitted by the light source 221 may be discharged outwardly along the light guide member 224 and the button 225.

In this case, the controller 230 may display an operating state of the communication module 200, for example, by a flickering period of the light source 221. The flickering period may be lighting of the light source 221 according to a prescribed pattern. The user may confirm an operating state of the communication module 200 by monitoring the flickering of the light source 221 according to a predetermined rule. In addition, the operating state of the communication module 200 may include an initialization state, a data reception state, or a normal operating state.

The light guide member 224 may slide toward the switch 226. More specifically, if the user pushes the button 225 exposed outwardly from the housing 201, the light guide member 224 may slide toward the switch 226. The controller 230 may proceed with initialization of the communication module 200 by judging a pattern in which the light guide member 224 pushes the switch 226. For example, the pattern of presses may be based on a time period, number of presses, or the like.

Initialization of the communication module 200 may include initialization of software to drive the controller 230 of the communication module 200. As described above, the circuit board 202 may be provided with the initialization circuit 223, to allow the user to directly proceed with initialization of the communication module 200 by pushing the button 225, or to proceed with initialization of the communication module 200 via the terminal 300.

Alternatively, the controller 230 may switch between operating modes of the communication module 200 or proceed with initialization of the communication module 200 based on pattern in which the guide member 224 is caused to activate the switch 226 (e.g., based on a time period). For instance, if the light guide member 224 pushes the switch 226 for a time period of 1 second or less, operating modes of the communication module 200 may be switched. If the light guide member 224 pushes the switch 226 for a time period of 3 seconds or more, initialization of the communication module 200 may proceed.

Here, the operating modes of the communication module 200 may include Pulse Width Modulation (PWM) and Universal Asynchronous Receiver/Transmitter (UART) modes. Additionally, on/off control, dimming control, or color temperature conversion of the lighting apparatus 100 are possible via PWM or UART communication. Moreover, the wireless communication unit 240 may include a ZigBee, Wi-Fi, Bluetooth, Z-wave unit, or another appropriate means of communication. The communication module 200 may be in wireless communication with the terminal 300 that controls the lighting apparatus 100.

As is apparent from the above description, a lighting apparatus according to an embodiment of the present disclosure may embody a lighting control system to achieve easy individual/group control in a wireless manner that does not require additional wiring at the installation site.

Further, according to an embodiment of the present disclosure, a separate wireless communication module may be separably coupled to the lighting apparatus, and thus on/off state, dimming, or color temperature of a lighting apparatus may be controlled in a wireless manner. Furthermore, according to an embodiment of the present disclosure, a lighting apparatus may achieve enhanced heat radiation performance, simplified assembly and installation as well as easy repair and replacement.

As embodied and broadly described herein, a lighting apparatus may include a heat sink, a light emitting unit including a substrate mounted on the heat sink and LEDs arranged on the substrate, a bulb surrounding the light emitting unit, an electronic modulereceived within the heat sink to supply power to the light emitting unit, a case configured to surround the electric unit, the case being inserted into the heat sink, a communication module separably coupled to the electric unit, and a power socket electrically connected to the electric unit, the power socket being mounted to the case, wherein the communication module includes a housing, a circuit board placed in the housing, the circuit board being electrically connected to the electric unit, and a wireless communication unit provided on the circuit board.

In accordance with another aspect of the present disclosure, a lighting apparatus may include a heat sink having a first aperture, a light emitting unit including a substrate mounted on the heat sink and LEDs arranged on the substrate, a bulb surrounding the light emitting unit, the bulb having a second aperture, an electronic modulereceived within the heat sink to supply power to the light emitting unit, a case configured to surround the electric unit, the case being inserted into the heat sink, a communication module separably coupled to the electronic modulethrough the first aperture or the second aperture, and a power socket electrically connected to the electric unit, the power socket being mounted to the case, wherein the communication module includes a housing, a circuit board placed in the housing, the circuit board being electrically connected to the electric unit, and a wireless communication unit provided on the circuit board.

A lighting apparatus may include a heat sink, a light emitting device including a substrate mounted on the heat sink and LEDs arranged on the substrate, a bulb surrounding the light emitting device, an electronic module received within the heat sink to supply power to the light emitting device, a case provided to surround the electronic module, the case being configured to be inserted into the heat sink, a communication module separably coupled to the electronic module and a power socket electrically connected to the electronic module, the power socket being mounted to the case wherein the communication module includes a housing, a circuit board provided in the housing, the circuit board being electrically connected to the electronic module, and a wireless communication device provided on the circuit board.

An aperture may be formed on a surface of the heat sink and the communication module may be configured to be coupled to the electronic module through the aperture. Further, an aperture may be formed on a surface of the case, the aperture on the case provided to correspond to the aperture on the heat sink, and the communication module is coupled to the electronic module through the apertures. The bulb may be provided on a top surface of the heat sink and the aperture on the heat sink may be provided on a lateral surface of the heat sink.

The lighting apparatus may also include a bulb that has an aperture and the communication module may be coupled to the electronic module through the aperture on the bulb. The heat sink may have an aperture formed on a top surface of the heat sink and positioned to correspond to the aperture on the bulb, the communication module being configured to be coupled to the electronic module through the aperture on the bulb and aperture on the heat sink. An auxiliary heat sink may be provided around a circumference of the aperture of the heat sink, the auxiliary heat sink protruding from the top surface of the heat sink.

The lighting apparatus may include a case with a connector configured to extend through the aperture on the heat sink and provided adjacent the auxiliary heat sink and the housing of the communication module may be configured to be provided through the aperture of the bulb and inserted into the connector on the case. The housing of the communication module may be separably coupled to the connector on the case. The light emitting unit may be radially arranged about the auxiliary heat sink.

The heat sink may have a second aperture and the communication module may be configured to be coupled to the electronic module through the second aperture on the heat sink. The electronic module may include a first connector positioned to correspond to the aperture in the bulb and a second connector positioned to correspond to the second aperture in the heat sink. The circuit board of the communication module may be configured to be inserted into the first connector or the second connector through the aperture in the bulb or the second aperture in the heat sink.

The bulb may include a reflector and the aperture on the bulb may be provided through the reflector. The reflector may be configured to reflect light emitted by the light emitting device toward the heat sink. The bulb may also include a through-hole and the reflective member that includes the aperture may be provided over the through-hole.

The communication module may include a display interface configured to display an operating state. The display interface may include a light source mounted on the circuit board, a light guide provided at the light source, a button coupled to the light guide and provided on the housing, and a switch coupled to the light guide. The light guide may be configured to guide light emitted by the light source to the button and to activate the switch based on a selection of the button.

The display interface may display an operating state of the communication module by illuminating the light source according to a prescribed pattern. The operating state of the communication module may include at least one of an initialization state, a data reception state, or a normal operating state.

The light guide may be configured to move toward the switch based on selection of the button and the communication module may be initialized based on a selection at the button.

In one embodiment, a lighting apparatus may include a heat sink having a first aperture, a light emitting device including a substrate mounted on the heat sink and LEDs arranged on the substrate, a bulb surrounding the light emitting device, the bulb having a second aperture, an electronic module received within the heat sink to supply power to the light emitting device, a case provided to surround the electronic module, the case being configured to be inserted into the heat sink, a communication module separably coupled to the electronic module through the first aperture or the second aperture, and a power socket electrically connected to the electronic module, the power socket being mounted to the case. The communication module may include a housing, a circuit board provided in the housing, the circuit board being electrically connected to the electronic module, and a wireless communication device provided on the circuit board.

In one embodiment, a communication module for a lighting apparatus may include a housing, a circuit board provided in the housing, and a wireless communication device provided on the circuit board and configured to communicate with an external device to control an operation of a lighting apparatus. The housing may have a prescribed shape and may be configured to be separably coupled to a connector provided on an electronic module of the lighting apparatus, the connector being provided at an aperture formed through a surface of a heat sink of the light emitting device such that the housing is mated with the connector through the surface of the heat sink. The aperture may be provided on at least one of an upper surface of the heat sink or a lateral surface of the heat sink.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus, comprising:

a heat sink;

a light emitting device including a substrate mounted on the heat sink and LEDs arranged on the substrate;

an enclosure surrounding the light emitting device;

an electronic device received within the heat sink that controls the light emitting device;

a case provided to surround the electronic device, the case being configured to be inserted into the heat sink;

a power socket electrically connected to the electronic device, the power socket being mounted to the case, wherein the electronic device includes a circuit board having a communication module and a power module provided on the circuit board, wherein the electronic device extends from the heat sink toward the enclosure through the substrate of the light emitting device,and wherein the circuit board includes a first circuit board and a second circuit board coupled to each other, the communication module provided on the first circuit board and the power module provided on the second circuit board.

2. The lighting apparatus according to claim 1, wherein an aperture is formed on a surface of the heat sink, and the electronic device extends through the aperture.

3. The lighting apparatus according to claim 1, wherein the electronic device extends parallel to a vertical axis of the heat sink through an aperture.

4. The lighting apparatus according to claim 1, wherein the substrate includes an aperture, the circuit board extending through the aperture on the substrate.

5. The lighting apparatus according to claim 4, wherein the circuit board extends perpendicular to the substrate mounted on the heat sink.

6. The lighting apparatus according to claim 2, wherein the enclosure is provided on a top surface of the heat sink and the aperture on the substrate is provided under the enclosure.

7. The lighting apparatus according to claim 6, wherein the enclosure surrounds the circuit board.

8. The lighting apparatus according to claim 7, wherein the enclosure is a bulb.

9. The lighting apparatus according to claim 1, wherein the heat sink has an aperture formed on a upper region of the heat sink, the circuit board extending through the aperture on the heat sink.

10. The lighting apparatus according to claim 9, wherein a first portion of the electronic device is positioned in the enclosure and a second portion of the electronic device is positioned in the heat sink.

11. The lighting apparatus according to claim 1, wherein a portion of the circuit board is positioned in the enclosure and a remaining portion of the circuit board is positioned in the heat sink.

12. The lighting apparatus according to claim 11, wherein the circuit board extends through an upper region of the heat sink.

13. The lighting apparatus according to claim 12, wherein an aperture is provided in the upper region of the heat sink under the enclosure, the circuit board extending through the aperture.

14. The lighting apparatus according to claim 12, wherein the circuit board extends parallel to a central vertical axis of the lighting apparatus.

15. The lighting apparatus according to claim 13, wherein the enclosure surrounds the circuit board.

16. The lighting apparatus according to claim 1, wherein the light emitting device is radially arranged about the communication module.

17. The lighting apparatus according to claim 1, wherein the LEDs arranged on the substrate of the light emitting device are arranged to surround the circuit board.

18. The lighting apparatus according to claim 17, wherein the substrate is perpendicular to the circuit board.

19. The lighting apparatus according to claim 17, wherein the substrate includes an aperture and the circuit board extends through the aperture on the substrate.

20. A lighting apparatus, comprising:

a heat sink;

a light emitting device including a substrate mounted on the heat sink and LEDs arranged on the substrate;

an enclosure surrounding the light emitting device;

an electronic device received within the heat sink that controls the light emitting device;

a case provided to surround the electronic device;

a power socket electrically connected to the electronic device, the power socket being mounted to the case, wherein the electronic device includes a circuit board having a communication module and a power module provided on the circuit board, the communication module including a wireless communication unit for wireless communication with a terminal that controls the lighting apparatus, wherein the electronic device extends toward the enclosure, and wherein the circuit board includes a first circuit board and a second circuit board coupled to each other, the communication module provided on the first circuit board and the power module provided on the second circuit board.

* * * * *